US005881980A

United States Patent [19]

Knudson

[11] Patent Number: 5,881,980

[45] Date of Patent: Mar. 16, 1999

[54] LEG ASSEMBLY

[76] Inventor: Edward C. Knudson, 2275 Ruth Louise La., Missoula, Mont. 59804

[21] Appl. No.: 884,403

[22] Filed: Jun. 27, 1997

[51] Int. Cl.[6] ..... A47B 91/02

[52] U.S. Cl. ..... 248/188.8; 248/161; 248/157; 248/188.9; 248/188.3; 16/42 R; 16/39; 16/38; 16/42 T; 403/90; 108/147.19

[58] Field of Search ..... 248/161, 188.8, 248/188.9, 188.5, 188.3, 354.3, 157, 412, 414; 411/24, 34, 907; 108/144.11, 146, 147, 147.19; 403/368, 290, 372, 104, 90, 409.1; 16/38, 39, 42 T, 42 R

[56] References Cited

U.S. PATENT DOCUMENTS

| | | | |
|---|---|---|---|
| 773,241 | 10/1904 | Wilton | 211/37 |
| 1,735,949 | 11/1929 | Brady | 248/411 |
| 1,919,666 | 7/1933 | Patterson | 16/38 |
| 2,238,705 | 4/1941 | Miller | 16/39 |
| 2,430,737 | 11/1947 | Roe | 16/39 |
| 2,513,193 | 6/1950 | Miller | 16/38 |
| 2,520,375 | 8/1950 | Roe | 16/39 |
| 2,542,967 | 2/1951 | Waechter | 248/188.5 |
| 2,842,415 | 7/1958 | Keller | 248/188.5 |
| 2,875,552 | 3/1959 | Stillman | 248/188.9 |
| 2,895,682 | 7/1959 | Tavone | 248/411 |
| 2,947,556 | 8/1960 | Wenger | 403/90 |
| 3,004,743 | 10/1961 | Wenger | 248/161 |
| 3,007,014 | 10/1961 | Bentman | 248/161 X |
| 3,080,601 | 3/1963 | Kramcsak, Jr. | 16/42 R |
| 3,117,392 | 1/1964 | Junkunc | 248/188.3 |
| 3,148,854 | 9/1964 | Junkune | 108/148 |
| 3,545,715 | 12/1970 | Triplett | 248/411 |
| 4,294,560 | 10/1981 | Larkin | 248/411 |
| 4,856,929 | 8/1989 | Smahlik et al. | 403/297 |

*Primary Examiner*—Ramon O. Ramirez
*Assistant Examiner*—Long Dinh Phan
*Attorney, Agent, or Firm*—Harry M Cross, Jr.

[57] ABSTRACT

An adjustable leg assembly comprises an outer tube and an inner tube subassembly. The inner tube assembly comprises an inner tube, a floor support at one end of the inner tube, an expandable bushing at an opposite end of the inner tube, a rod extending through the inner tube and secured to the bushing and threadedly engaged with the floor support. The inner tube subassembly is inserted into the outer tube such that the bushing is confined within the outer tube and can be expanded into and retracted from contact with the outer tube by turning the floor support relative to the inner tube. In the preferred embodiment illustrated in the drawings, the floor support is a glide/tightener that provides a floor glide to support the leg assembly and that provides a tightener that is threadedly engaged with the bushing rod.

11 Claims, 3 Drawing Sheets

FIG. 3
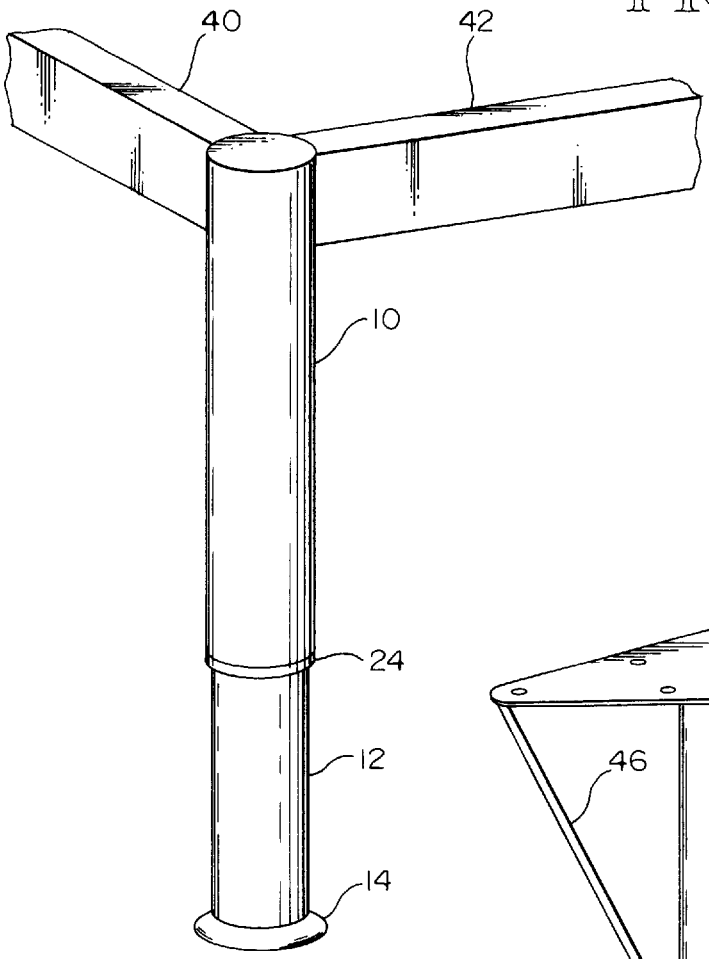
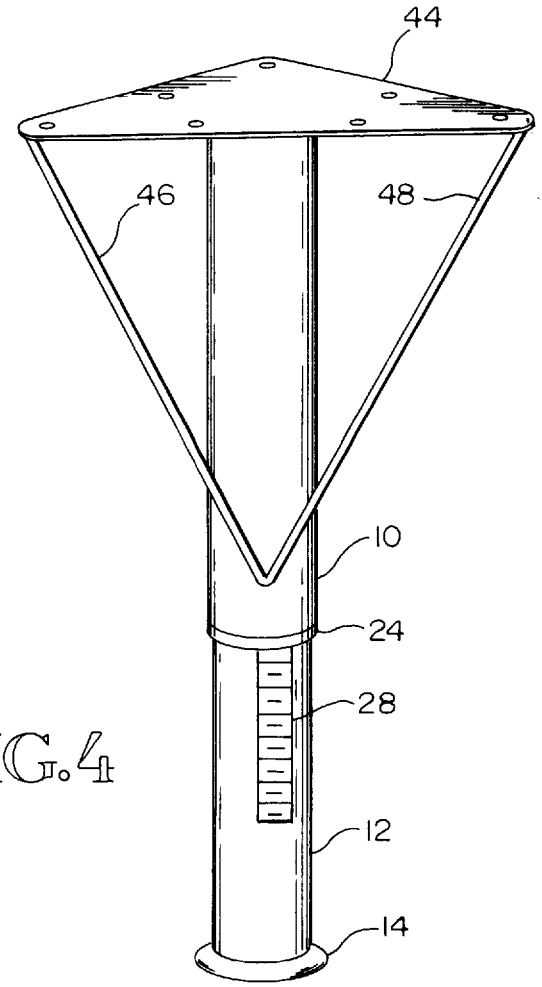
FIG. 4

LEG ASSEMBLY

BACKGROUND OF THE INVENTION

Field of the Invention

This invention relates to adjustable legs for supporting beds, tables, desks, platforms and the like. More particularly, this invention relates to such legs that are telescopically adjustable.

SUMMARY OF THE INVENTION

A primary object of this invention is to provide a telescopically adjustable leg assembly that can be adapted for use to support a variety of different objects, such as bed, tables, desks, platforms and the like. It is another object to provide such a leg assembly that is convenient to adjust and secure when adjusted. A further object is to provide such a leg assembly that is simple in construction and easy to manufacture and assemble.

These objects and advantages will become apparent from the following description of the invention.

In accordance with these objects and advantages, the invention comprises an adjustable leg assembly which having an outer tube, an inner tube subassembly comprising an inner tube, a floor support at one end of the inner tube, an expandable bushing at an opposite end of the inner tube, a rod extending through the inner tube and secured to the bushing and threadedly engaged with the floor support. The inner tube subassembly is inserted into the outer tube such that the bushing is confined within the outer tube and can be expanded into and retracted from contact with the outer tube by turning the floor support relative to the inner tube. In the preferred embodiment illustrated in the drawings, the floor support is a glide/tightener that provides a floor glide to support the leg assembly and that provides a tightener that is threadedly engaged with the bushing rod.

BRIEF DESCRIPTION OF THE DRAWINGS

FIG. 3 is a partial perspective view of the leg assembly of this invention mounted to a framework; and FIG. 4 is a perspective view of the leg assembly of this invention mounted to a flange plate.

DESCRIPTION OF THE PREFERRED EMBODIMENT

Figure 1:
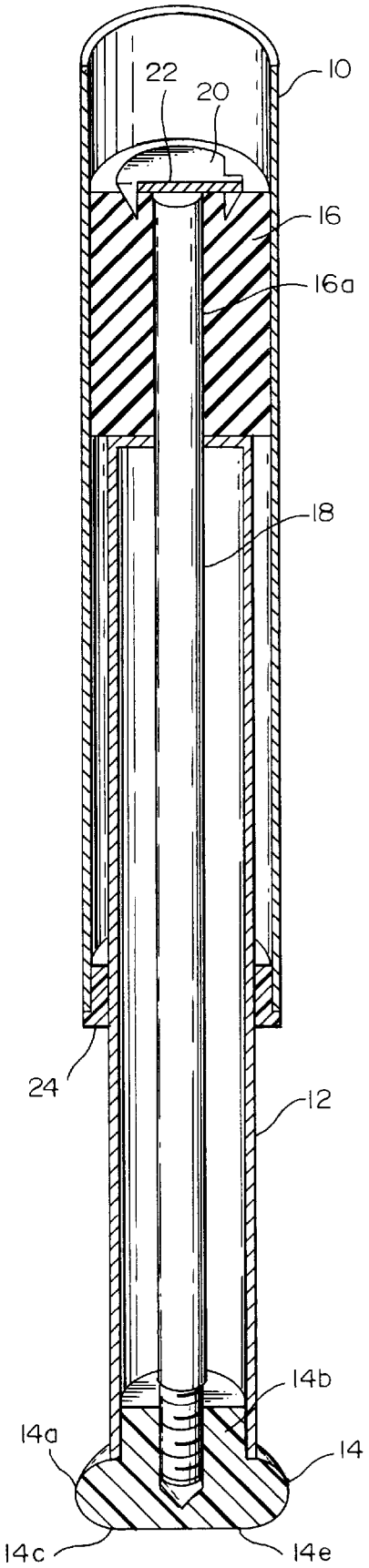
FIG. 1 is a vertical cross-section view in perspective of the leg assembly of this invention.
Figure 2:
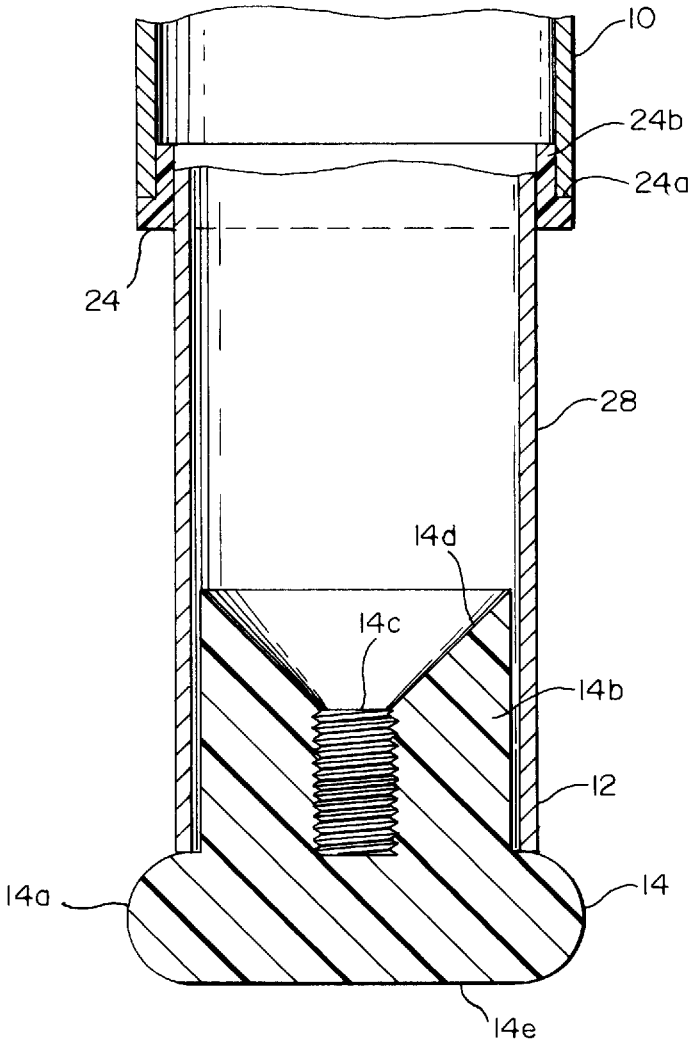
FIG. 2 is an enlarged partial view of another embodiment of the leg assembly of this invention.

Referring to FIGS. 1 and 2, the adjustable leg assembly of this invention comprises two telescopically extendable tubes 10 and 12, tube 12 being telescopically extendable in and out of tube 10. The assembly further comprises a leg glide and tightener 14 at the outer end of tube 12, an expandable cylindrical bushing 16 at the inner end of tube 12, and a tightening rod 18 extending between glide/tightener 14 and bushing 16.

The inner end of rod 18 is secured to bushing 16 by means of a pronged pallet nut 20. Nut 20 is securely attached to the inner end of rod 18, as by being welded thereto. Nut 20 has depending prongs that are inserted into one end of bushing 16. This combination, as seen in FIG. 1, with rod 18 extending axially through bushing 16, secures the bushing 16 to the rod 18 such that the two act in unison. When rod 18 is turned, therefore, bushing 16 will also be turned to the same degree.

The outer end of rod 18 is threaded and is threadedly engaged with glide/tightener 14. Glide/tightener 14 is provided with an axial threaded cylindrical passage for threadedly accepting the threaded end of rod 18.

When the assembly is assembled into the form shown in FIG. 1, inner tube 12 rests on the glide/tightener 14 and extends into outer tube 10. The bushing 16 is supported at the inner end of inner tube 12 by means of a washer 22 that closes the inner end of tube 12 as shown. Rod 18 extends through the inner tube 12 and into the threaded passage within glide/tightener 14 as shown. A bearing sleeve 24 is provided between the open end of outer tube 10 and the outer surface of inner tube 12 as shown to space the tubes so as to help maintain the tubes in axial alignment. Inner tube 12 is maintained in axial alignment with outer tube 10 by the bearing sleeve 24 and the expandable bushing 16.

When glide/tightener 14 is turned in one direction, typically clockwise, it is threaded further onto rod 18, thereby drawing the nut 20 toward the glide/tightener 14. As nut 20 is drawn toward glide/tightener 14, bushing 16 is compressed between the nut 20 and the washer 22, thereby expanding the side wall of the bushing and squeezing it against the inner surface of the outer tube 10. Consequently, the expanded bushing 16 is locked against the outer tube 10 with the result that telescopic movement between the two tubes is prevented. Therefore, the relative axial positions of the two tubes is locked.

When glide/tightener 14 is turned in the opposite direction, it is unthreaded from rod 18, thereby releasing the compressive force, acting through nut 20, on bushing 16 so that the bushing can relax. When the bushing relaxes sufficiently, it retracts from locking contact with tube 10, thereby unlocking the two tubes so that they can be telescopically moved relative to one another.

A distinctive feature of the leg assembly of this invention is the above-described arrangement that permits an operator to grasp the inner tube 12 and hold it against rotation while the operator turns glide/tightener 14 relative to tube 12. By holding tube 12 against rotation, the bushing 16 may be compressed and relaxed without encountering slippage of the bushing within inner tube 10. When the glide/tightener 14 is tightened onto rod 18, any tendency of rod 18 to turn with glide/tightener 14, rather than be simply drawn into the glide/tightener, can be successfully resisted by the operator holding onto the inner tube 14. To further enhance the non-slipping character of the bushing, the washer 22 could be provided with a roughened surface that abuts the bushing 16. Likewise, when the glide/tightener is loosened from rod 18, by holding the inner tube 12, any tendency of the bushing to slip within the outer tube 10 can be successfully resisted so that the two tubes can be unlocked.

As seen in FIG. 2, the bearing sleeve 24 is stepped to provide an outer annular shoulder 24*a* against which the outer end of the outer tube 10 abuts, and a smaller diameter shaft 24*b* that extends into the open end of tube 10. The inner diameter of shaft 24*b* matches the outer diameter of inner tube 12 so that the two have a slip fit tolerance between them. As a consequence of this configuration of sleeve 24, during assembly of the leg assembly, the inner tube subassembly (tube 12, glide/tightener 14, bushing 16, rod 18, nut 20 and washer 22) may be inserted into outer tube 10 before bearing sleeve 24 is inserted into tube 10. Subsequently, the bearing sleeve 24 can be inserted into tube 10 so as to confine the inner tube subassembly telescopically within tube 10. The outer diameter of shaft 24*b* matches the inner diameter of outer tube 10 so that the two have a friction fit tolerance between them, such that sleeve 24 would be press-fit onto tube 10. The relative diameters of the two tubes, the inner diameter of outer tube 10 and the outer diameter of inner tube 12, can be almost the same, leaving only a small cylindrical space for the shaft 24*b* of bearing sleeve 24.

Glide/tightener 14 is formed to provide a floor glide 14*a* and a tightener shaft 14*b*. Shaft 14*b* extends axially outward from the glide 14*a* and is provided with an axial threaded cylindrical passage 14*c* for the threaded end of rod 18. Passage 14*c* is threaded deeply enough so that rod 18 can be inserted deeply enough into shaft 14*b* to enable glide/tightener 14 to be tightened sufficiently so as to cause bushing 16 to expand into locking engagement with outer tube 10. The outer diameter of shaft 14*b* matches the inner diameter of inner tube 12 so that the two have a slip fit tolerance between them so that glide/tightener 14 can be easily turned within tube 12. Consequently, when glide/tightener is loosened on rod 18, there will be some axial play between glide 14 and inner shaft 12 and between washer 22 and bushing 16. When glide/tightener 14 is tightened onto rod 18, however, that play will be removed and the inner tube subassembly will become an axially rigid unit. Glide section 14*a* is formed to provide a base surface against which the end of inner tube 12 seats as shown in FIG. 2 when the inner tube assembly becomes a rigid unit.

The inner tube subassembly is assembled by inserting rod 18 through the axial passage 16*a* in bushing 16 and pressing the prongs of nut 20 into the end of the bushing, inserting the rod 18 through the inner tube 12, inserting the glide/tightener 14 into the opposite end of tube 12, and threading glide/tightener 14 onto the threaded end of rod 18. To facilitate this assembly process, the inner end of passage 14*c* may be flared outwardly in a frusto-conical opening 14*d* so as to make glide/tightener 14 self-centering relative to rod 18.

Expandable bushing 16 may be fabricated from any material that is elastic and compressible so that it can be compressed and expanded against outer tube 10 and so that it will return to its original configuration when relaxed. Glide/tightener 14 may be fabricated from any material or combination of materials that provide a sufficiently durable support-contacting surface 14*e* and that provide a sufficiently durable threaded passage 14*c*. Rod 18 may be fabricated from any material or combination of materials that can be threaded and secured to nut 20. Rod 18 may be threaded completely along its shaft or threaded only on the portion that engages threaded passage 14*c*. Pronged pallet nut 20 may be replaced by any suitable fastener that can be fixed to rod 18 and to bushing 16 such that bushing 16 will not turn relative to rod 18, and that can transfer compressive pressure into the end of bushing 16 to effect its expansion against tube 10.

The glide/tightener 14 may be provided with a castor assembly in place of the support-contacting surface 14*e*, so long as the functions detailed above are provided. For this, the floor glide 14*a* would be configured to receive the post of a castor assembly so that the castor wheel could freely rotate and revolve below glide 14*a*.

The telescopic leg assembly of this invention can be fastened to any number of different kinds of objects. For example, FIG. 3 and 4 illustrate two different form of attachment to a framework. In FIG. 3 the leg assembly 1 is connected to a pair of rectangular tubes 40, 42, so as to make up, for example, a corner leg for a bed frame. In FIG. 4 the leg assembly 1 is connected to a flange plate 44, flange plate 14 being reinforced by a pair of supports 46, 48. In the case of FIGS. 3 and 4, the attachments are to the outer tube 10, leaving the inner tube 12 unencumbered. The FIG. 4 arrangement provides a leg assembly that can be fastened to any object such as a table or desk or to a platform or the like. The lengths of the outer and inner tubes 10, 12 can be selected based on the object to be supported. Their lengths can be longer or shorter as deemed necessary for a particular application.

To facilitate leveling of a supported object, the leg assembly may be provided with a height adjustment scale, such as a scale decal 28 placed on the outer surface of the inner tube 12, such that the relative location of the lower edge of sleeve 24 to the markings on the decal 28 can be ascertained. Particularly where two or more leg assemblies are incorporated into a device. By adjusting both leg assemblies to the same markings on the scale, the legs will be of the same length.

While the preferred embodiment of the invention has been described herein, variations in the design may be made. The scope of the invention, therefore, is only to be limited by the claims appended hereto.

The embodiments of the invention in which an exclusive property is claimed are defined as follows:

What is claimed is:

1. An adjustable leg assembly which comprises an outer tube having an open end, an inner tube subassembly comprising an inner tube, a floor support at one end of said inner tube, an expandable bushing at an opposite end of said inner tube, a rod extending through said inner tube and secured to said bushing and threadedly engaged with said floor support; said inner tube subassembly being inserted through the outer tube open end and into said outer tube such that said bushing is confined within said outer tube and can be expanded into and retracted from contact with said outer tube by turning said floor support relative to said inner tube.

2. The leg assembly of claim 1 wherein said floor support comprises a glide formed to fit into said one end of said inner tube and provide an internal threaded passage for threadedly receiving a threaded end of said rod.

3. The leg assembly of claim 2 wherein the threaded passage in said glide is provided with a frusto-conical opening to said inner tube whereby said glide is self-centering with respect to said rod threaded end.

4. The leg assembly of claim 1 wherein said opposite end of said inner tube is capped with a bushing support, said bushing bearing against said bushing support when expanded into contact with said outer tube.

5. The leg assembly of claim 2 wherein said opposite end of said inner tube is capped with a bushing support, said bushing bearing against said bushing support when expanded into contact with said outer tube.

6. The leg assembly of claim 1 including a pair of horizontal supports secured to said outer tube so that said leg assembly is an integral part of said supports.

7. The leg assembly of claim 2 including a pair of horizontal supports secured to said outer tube so that said leg assembly is an integral part of said supports.

8. The leg assembly of claim 1 including a flange plate mounted to one end of said outer tube with said inner tube subassembly protruding from an opposite end of said outer tube.

9. The leg assembly of claim 2 including a flange plate mounted to one end of said outer tube with said inner tube subassembly protruding from an opposite end of said outer tube.

10. The leg assembly of claim 1 including a sleeve spacer secured to the open end of said outer tube and slidably receiving said inner tube so as to axially space said inner tube within said outer tube.

11. The leg assembly of claim 2 including a sleeve spacer secured to the open end of said outer tube and slidably receiving said inner tube so as to axially space said inner tube within said outer tube.

* * * * *